US005898353A

United States Patent [19]

Cader et al.

[11] Patent Number: 5,898,353

[45] Date of Patent: Apr. 27, 1999

[54] MAGNETIC FLUID COOLER TRANSFORMER

[75] Inventors: Tahir Cader, Woodinville; Samuel Bernstein, Bellevue; Clayton Crowe, Pullman, all of Wash.

[73] Assignee: Electric Power Research Institute, Palo Alto, Calif.

[21] Appl. No.: 08/876,851

[22] Filed: Jun. 17, 1997

[51] Int. Cl.[6] ..... H01F 27/08

[52] U.S. Cl. ..... 336/60; 336/846

[58] Field of Search ..... 336/60–62, 846

[56] References Cited

U.S. PATENT DOCUMENTS

| | | | |
|---|---|---|---|
| 3,168,777 | 2/1965 | Ridder et al. | 336/60 |
| 5,412,304 | 5/1995 | Abbott | 336/60 |
| 5,462,685 | 10/1995 | Raj et al. | 252/62.56 |

OTHER PUBLICATIONS

Strategic R&D Letter, Issue No. 25, Oct. 1996.

Inside R&D, vol. 25, No. 51, Dec. 1996.

Process, Enhanced, and Multiphase Heat Transfer, A. Festschrift for A.E. Bergles. pp. 287–293, Nov. 1995.

Magnetohydrodynamics, vol. 16, No. 1, pp. 48–60, Jul. 1980.

*Primary Examiner*—Lincoln Donovan

*Attorney, Agent, or Firm*—Jerry G. Wright; Flehr Hohbach Test Albritton and Herbert LLC

[57] ABSTRACT

Convective cooling of a distribution transformer is enhanced by use of magnetic fluid which has a magnetically driven flow pattern in the form of a plurality of vertically stacked magnetic circulation cells with convective heat transfer being enhanced by modifying the configuration of a proximate transformer wall to facilitate the transfer of heat from the magnetic fluid to the wall and then to the ambient air.

15 Claims, 6 Drawing Sheets

MAGNETIC FLUID COOLER TRANSFORMER

The present invention is directed to an electromagnetic device producing an external alternating magnetic field which is immersed in a magnetic fluid and more specifically, an improved cooling technique for a transformer.

A typical pole mounted single phase transformer (or other utility type transformer) can be oil cooled, where the oil heats up when in contact with the core and/or coil of the transformer rises, and circulates over to the outer drum wall (the transformer is usually circular) and then as it descends loses heat to the outside air. Various fins and tubes are also used to promote cooling. U.S. Pat. No. 5,462,685 (as well as many other prior art references) discloses that replacing the oil with a magnetic fluid provides a means to improve cooling. The theory of this patent is that through changes in the (temperature-dependent) saturation magnetization of the magnetic fluid the magnetic field preferentially draws the cooler magnetic fluid towards the transformer to displace previously heated hot magnetic fluid in contact with the transformer.

How to fully utilize the fluid motion brought about by changes in fluid density, magnetization or other mechanisms related to interaction with the transformer's alternating magnetic field has not yet been determined in the prior art.

OBJECT OF THE INVENTION

It is therefore an object of this invention to provide a modified electromagnetic device producing an alternating magnetic field which has improved cooling by being immersed in a magnetic fluid.

In accordance with the above object there is provided an electromagnetic device producing an external alternating and gradient magnetic field comprising a substantially closed liquid retaining container for holding the device having at least one wall in proximity to it. Magnetic fluid is retained by the container submerging the device in it, the fluid having a circulation pattern in the form of a plurality of circular flow paths between the wall and the device. The wall has an interior configuration substantially matching the circulation pattern to enhance heat transfer from the device to the wall.

Alternatively rather than an electromagnetic device (e.g., transformer) an external magnetic field may be imposed on a heat producing device immersed in the magnetic fluid.

DETAILED DESCRIPTION OF PREFERRED EMBODIMENTS

Figure 1:
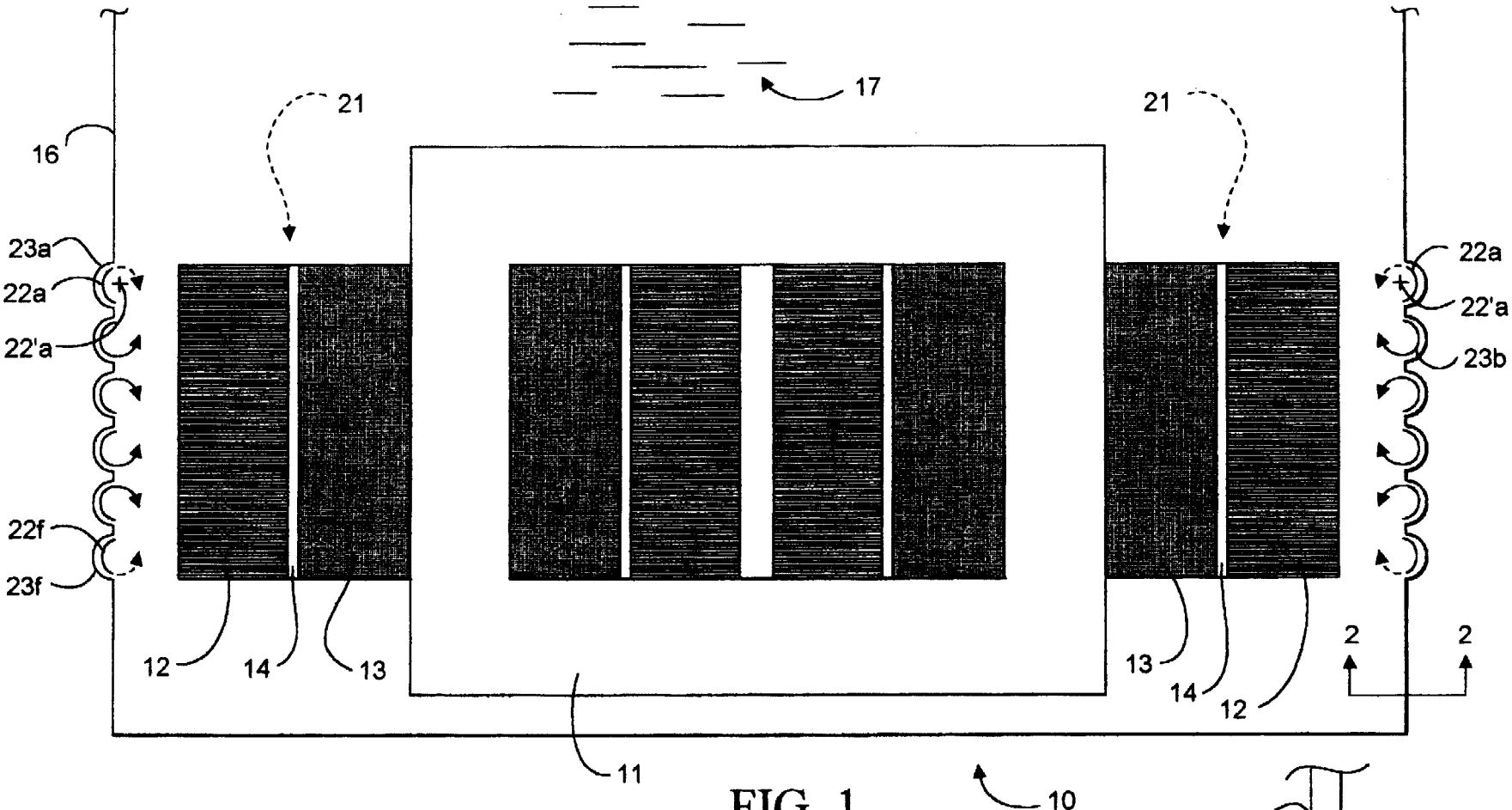
FIG. 1 is a simplified cross sectional view of a transformer embodying the present invention.

FIG. 1 illustrates an electromagnetic device, specifically a transformer 10 which in a typical manner has a rectangular iron core 11, and a pair of primary windings 12, and a pair of secondary windings 13 encircling the two vertical legs of core 11. Insulation 14 of course separates the two windings. The core 11 and windings 12, 13 are held in a cylindrical container 16 which retains a magnetic fluid indicated at 17 in which all the portions of the core and coils of the transformer are immersed. The type of magnetic fluid may possess a saturation magnetization of 90 Gauss, or be of the type of fluid mentioned in the above '685 patent.

In operation when a voltage is applied to the transformer windings magnetic flux appears, of course, in the core and then links the secondary to the primary windings. There are also outside leakage magnetic flux paths, generally indicated at 21. The strength of the leakage flux paths 21 decreases from the vicinity of the core and coil toward the wall of the transformer container 16. Thus, a gradient magnetic field as well as an alternating magnetic field are formed. It is believed that this combination of alternating magnetic field and gradient magnetic field, along with an interaction with gravitational convection, causes the magnetic fluid to form a plurality of magnetic circulation or roll cells indicated as **22*a* through 22*f*, each having a rotation or circulation around its own individual axis 22'*a***, etc.

As illustrated in FIG. 1, where the container 16 is circular, each roll cell is in the shape of a doughnut. In order to take full advantage of these roll cell circulation patterns to enhance heat transfer, the container wall 16, in the embodiment of FIG. 1 includes a matching set of lobes or arcuate portions **23*a* through 23*f***.

Figure 2:
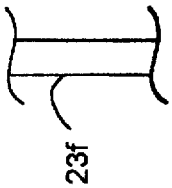
FIG. 2 is a cross sectional view taken along the line 2—2 of FIG. 1.

FIG. 2 illustrates an end view of the lobes. The heat transfer effect of the circulation pattern of the roll cells **22*a*–22*f* will be maximized by this interior configuration of the container 16 and the fact the wall is in relatively close proximity to the coils 12 and 13 so that the magnetic field 21** still has some effect.

Figure 3:
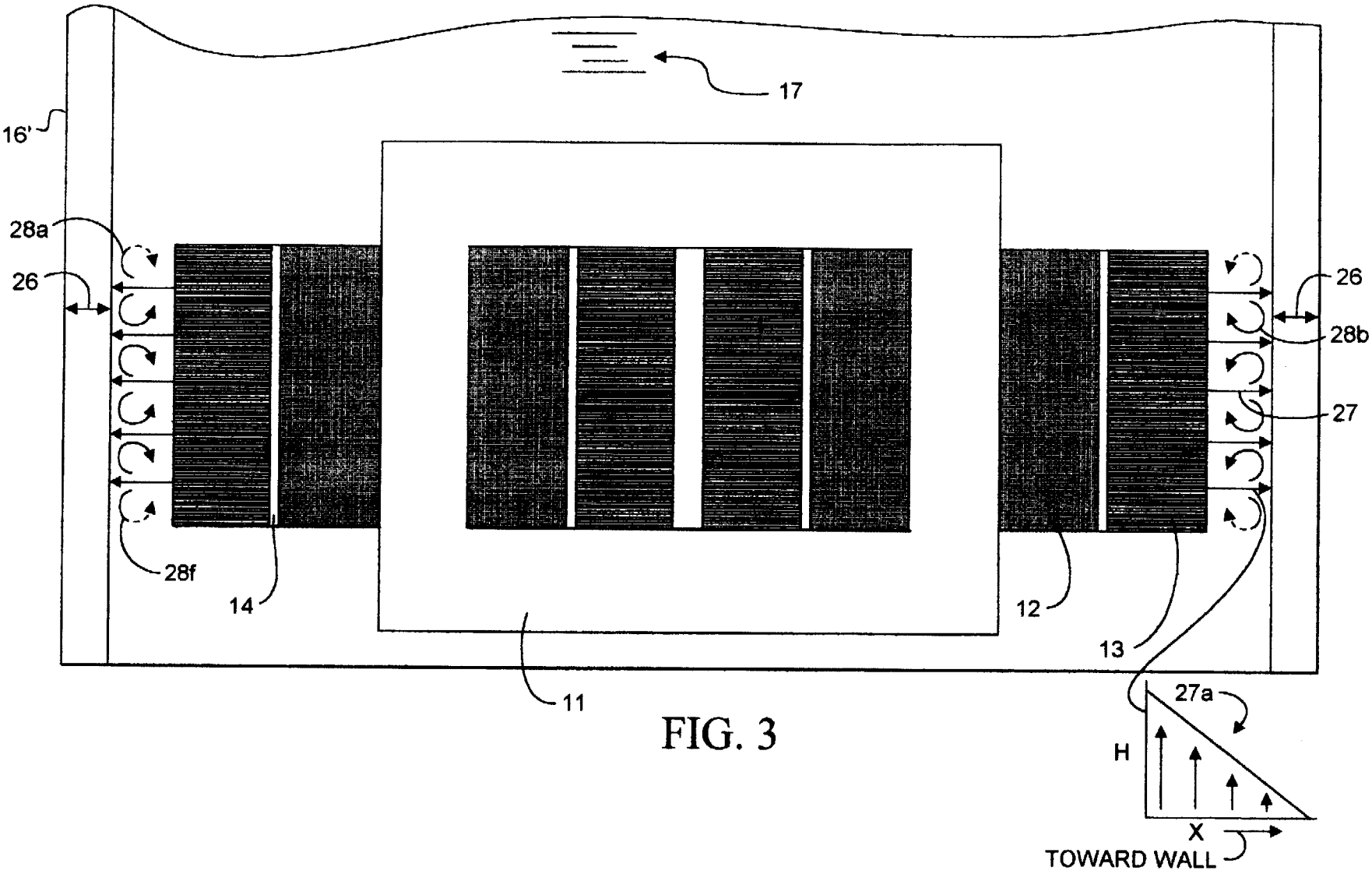
FIG. 3 is a simplified cross sectional view of a standard transformer but showing the concept of the invention and how it is not effective in a standard transformer.
Figure 4:
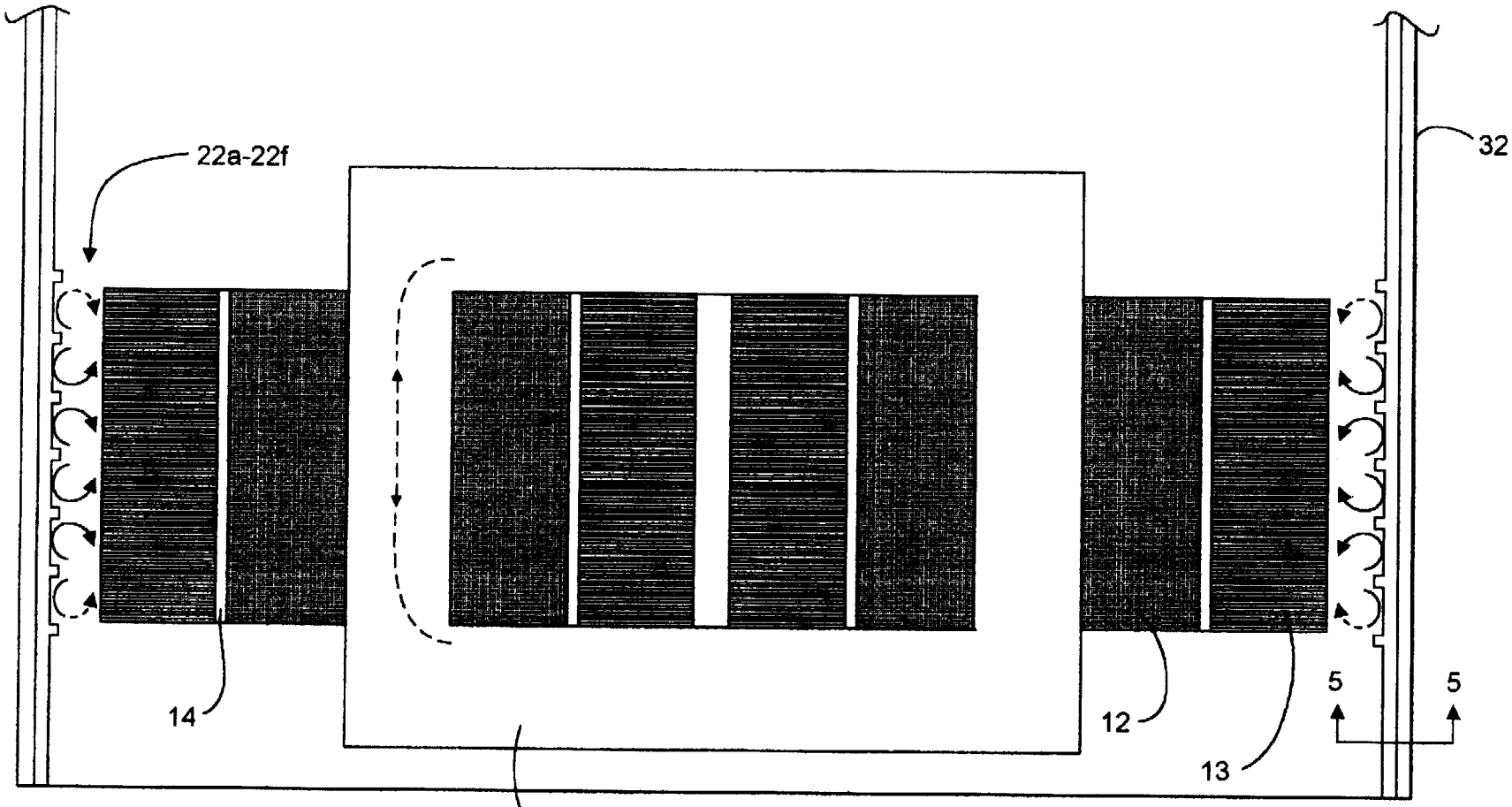
FIG. 4 is a cross sectional view similar to FIG. 1 but of an alternative embodiment.
Figure 6:
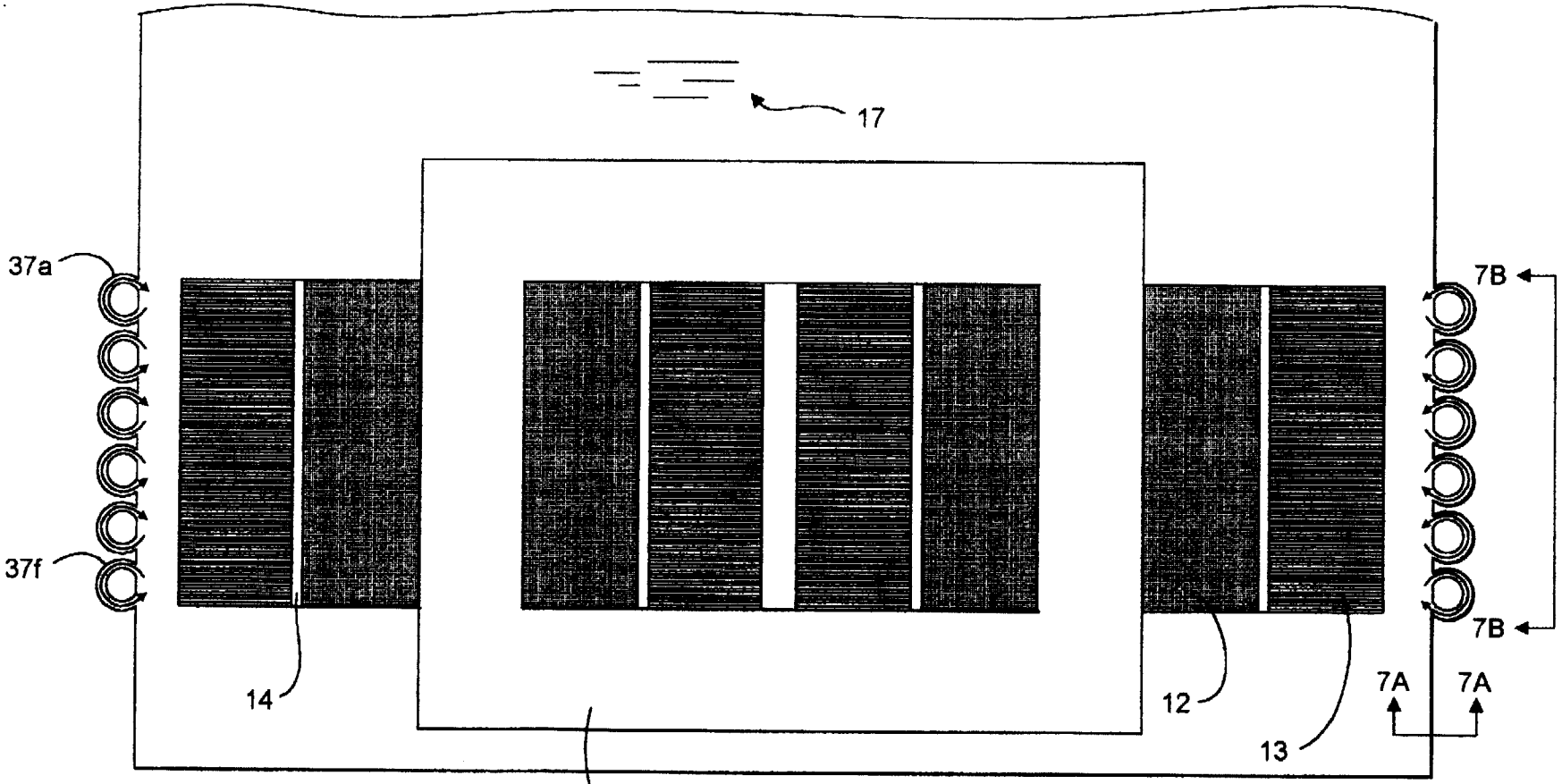
FIG. 6 is a simplified cross sectional view of a transformer similar to FIG. 1 but an alternative embodiment.

The theory of the invention is more clearly illustrated and can be explained in conjunction with FIG. 3 which is a more typical transformer container 16' where the core 11 and the primary secondary coils 12 and 13 are suspended in the magnetic fluid 17 but where the container wall 16' is far from the magnetic field. Here as indicated by the double ended arrow 26 the magnetic field is so weak in this area as to not affect circulation of the magnetic fluid 17 and to not enhance heat transfer; in fact, heat transfer to outer wall 16' may be inhibited. Lines 27 illustrate direction of magnetic force due to the magnetic field gradient toward the container wall 16' in the magnetic fluid. The gradient field decreasing toward wall 16' and space 26 is illustrated by diagram **27*a*. And then the dashed portion of, for example, the end roll cell 28***f* indicates the weakening of the magnetic field as the distance from the core and coils is increased. (This effect is also shown in FIGS. 1, 4 and 6.) On the other hand the magnetic circulation pattern for roll cell 28*b* has a relatively strong field. However, it is clear from FIG. 3 that without the close proximity of the wall and its modified configuration that even though small-scale turbulence is introduced because of the use of magnetic fluid it is not utilized effectively to improve heat transfer and will result in almost no improvement over pure oil-cooling and possibly even decreased cooling performance due to increased thermal resistance across the vertical layer indicated at 26.

One other observation regarding a comparison of FIGS. 1 and 3 and the number of magnetic circulation or roll cells is that the number of the cells as well as their specific size may be dictated by transformer type and associated thermal and velocity fields. However it is believed that by taking into account fluid dynamics, energy conservation and mathematical considerations that the roll cells 22*a* through 22*f* have substantially horizontal axes 22'*a*–22'*f*, and that these cells are substantially vertically stacked, as illustrated in both FIGS. 1 and 3. Moreover as indicated, going back to FIG. 1, for example, between roll cells 22*a* and 22*b* the circulation of adjacent roll cells is opposite (in other words, counterclockwise and clockwise) so that there is a point of substantially zero velocity difference between roll cells.

Lastly, the alternating field causes the individual particles to alternate at the microscale. The alternating particles entrain the surrounding carrier fluid (oil base), the sum of all alternating particles resulting in the macroscopic motion demonstrated by roll cells 22*a* through 22*f*. Roll cells 22*a* through 22*f* which possess too much momentum to follow the frequency of the magnetic field, along with their interaction with gravitational convection, necessarily result in the roll cell pattern.

The supposition of the existence of said roll cells 22*a*–22*f* is supported by experimental and numerical evidence. A model of one leg of the typical transformer 10 was designed and instrumented for detailed temperature measurements, and immersed in magnetic fluid 17. Leakage fields 21 were experimentally approximated and detailed temperature measurements performed for a variety of conditions. The experimental set-up was mathematically modeled for the same experimental conditions. The mathematical model was designed to provide information on the temperature and velocity distributions of the magnetic fluid surrounding the transformer model. The experimental results were qualitatively reproduced by the mathematical model for a variety of cases, and both strongly indicated the existence of roll cells. Scale-up of laboratory results to full-scale systems is standard engineering practice, and thus supports the idea of the existence of the plurality of vertically stacked roll cells. Moreover, despite the presence of the alternating field and the tendency of the magnetic fluid particles to alternate with the magnetic field, the gravitational (free) convection will combine with the magnetically-induced motion to create an overall motion described by the roll cells 22*a*–22*f*. At the small-scale, the individual particles of the magnetic fluid 17 will alternate with the magnetic field, creating a turbulent situation, thereby increasing the fluid's effective thermal conductivity and a resulting increase in the heat transfer.

Thus, in summary in view of the fluid dynamics and mathematical aspects of how the turbulence is induced by the alternating magnetic field, the present invention for the first time has discovered the foregoing specific circulation pattern. Moreover, by closely matching the configuration of the transformer wall to the roll cell pattern, and by placing the wall in closer proximity to the roll cells, heat transfer from the transformer to the outside air will be significantly enhanced.

FIG. 4 illustrates an alternative embodiment of FIG. 1 where the transformer wall 16 has an interior configuration in the form of horizontal protuberances 31*a* to 31*g* which are spaced to conform to the roll cells 22*a* through 22*f*. It should be emphasized that both FIGS. 1 and 4 are theoretical drawings of the roll cells including their number and diameter and that no actual measurements of the number or diameter of cells has specifically been made. But through the necessary mathematics of the process, it is believed that FIGS. 1 and 4 more closely approximate the concept of the invention, both theoretically and spatially.

Figure 5:
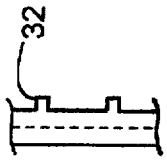
FIG. 5 is a cross sectional view taken along the line 5—5 of FIG. 4.
Figure 10:
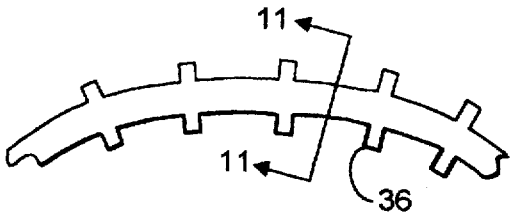
FIG. 10 is a cross sectional view of a portion of the wall of a transformer illustrating another embodiment of the invention.
Figure 11:
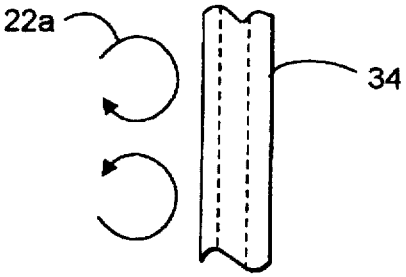
FIG. 11 is a cross sectional view taken along the line 11—11 of FIG. 10 also showing magnetic fluid circulation.

Finally the outer wall of FIG. 4 is shown in FIG. 5 and includes a number of vertical cooling grids 32. Other variations in the transformer wall interior configurations are illustrated in FIGS. 8 through 11 where in FIG. 8 the wall 16 has interior pointed vertical protuberances 33 circumferentially arranged to provide increased surface area and therefore increased heat transfer. The vertical external juxtaposed fins 34 providing for conduction, radiation and convection to the air. FIGS. 10 and 11 show the same type of external vertical protuberance 34 with a matching interior vertical protuberance 36.

Yet another embodiment of the invention is illustrated in FIG. 6 where in an attempt to duplicate the fluid flow of the fin transformer, partial hollow rings 37*a* through 37*f* extend from the wall 16 and have a radius of curvature similar to the roll cells 22*a* through 22*f*.

Figure 7A:
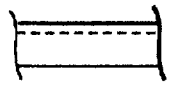
FIG. 7A is a cross sectional view taken along the line 7A—7A of FIG. 6.
Figure 7B:
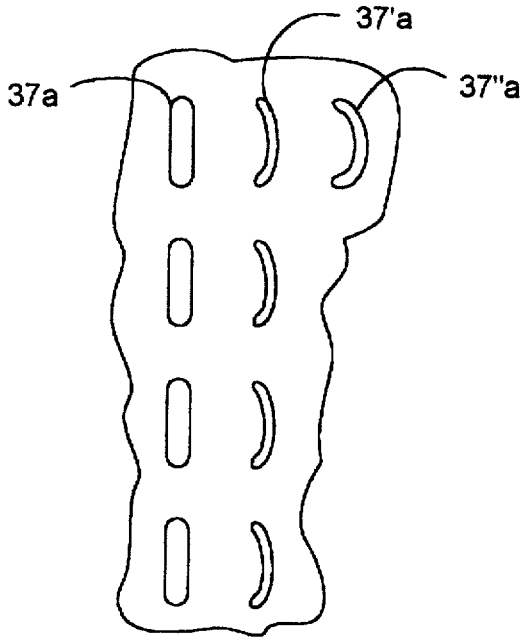
FIG. 7B is a plan view taken substantially along the line 7B—7B of FIG. 6.
Figure 8:
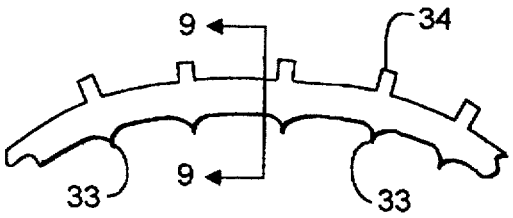
FIG. 8 is a cross sectional view of a portion of the wall of a transformer illustrating another embodiment of the invention.
Figure 9:
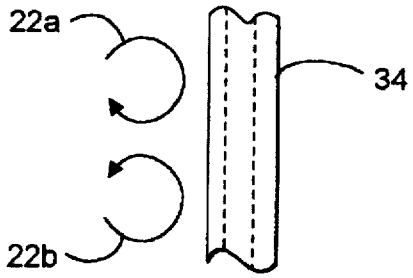
FIG. 9 is a cross sectional view taken along the line 9—9 of FIG. 8, also showing magnetic fluid circulation.
Figure 12:
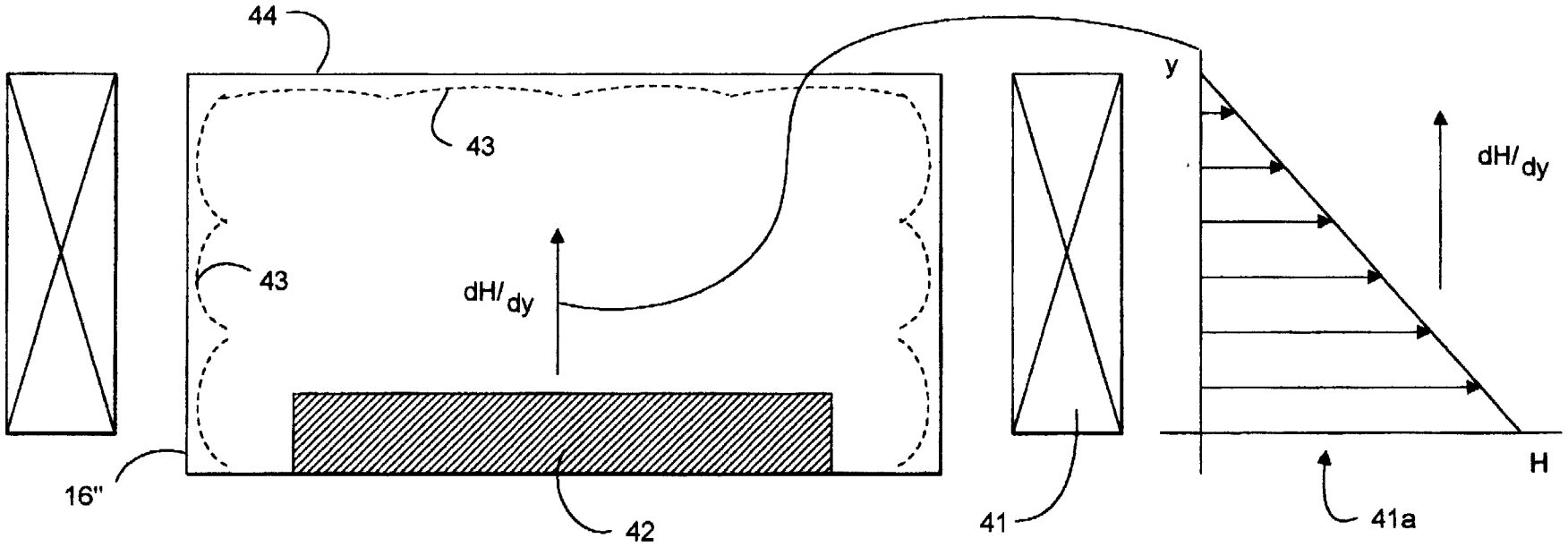
FIG. 12 is a cross sectional view of another embodiment of the invention.

The hollow rings being in a doughnut shape, are discrete as illustrated in FIG. 7B with a number of vertical columns around the periphery of the transformer and indicated by, for example, 36'*a*, 37'*a* and 37"*a*. The vertical spacing and the size of the circulating hollow rings is dictated by the number and size of the magnetic circulation cells present in the magnetic fluid. However, it is believed that even if a perfect match is not achieved providing a plurality of the "coffee cup handle" fins, this will still significantly enhance heat transfer. FIG. 12 illustrates an alternative embodiment of the invention where rather than an electromagnetic device such as a transformer producing its own magnetic field an imposed alternating magnetic field is provided by the electromagnet 41 about a container 16". The container, of course, contains the magnetic fluid 17 and it immerses a heat producing device such as, for example, an integrated circuit 42. This is possible because the magnetic fluid is essentially an insulator. And, of course, the container 16" would be of magnetically permeable material. Thus electromagnet 41 produces the gradient field shown at 41*a* where the intensity decreases on the vertical, y, axis. In accordance with the concept of the present invention, the container side wall 16" and top wall 44 would include as indicated by the dashed lines 43 an interior configuration to match roll patterns.

Thus the mechanism by which heat transfer between the device (be it a transformer or a passive device such as integrated circuit) and the container wall is increased by an increase in the effective thermal conductivity of the magnetic fluid is quite complicated. Of course, as discussed above, as the temperature of the fluid increases, its saturation magnetization decreases, resulting in poor attraction of the magnetic fluid to the magnetic field. This is disclosed in the '685 patent discussed above. It is believed this effect contributes to the roll cell development. In addition the alternating and gradient magnetic field causes the magnetic particles to alternate at some related frequency and results in a form of turbulence that causes the thermal diffusion at the small-scale to increase there. In effect is provided passive turbulence generation with no moving parts and with no additional maintenance apart from what is apparent in transformer operation. The gravitational convection, of course, has been discussed above where the heated fluid is lighter and tends to rise and also there is less attraction by the magnetic field because its saturation magnetization decreases. Because this gravitational convection combines with the magnetically induced motion, the result is the roll cells. Thus because of the combination of the overall motion and the small-scale motion the effective thermal conductivity of the magnetic fluid is increased. To take advantage of this increased effective thermal conductivity, the outer container wall is modified. Effective thermal conductivity relates to the entire heat transfer process and includes the effects of radiation, convection, conduction and both magnetically induced motion and gravitational convection due to changes in density; in other words, all heat transfer mechanisms.

Thus, in summary with the realization that the alternating magnetic field and its gradient along with their interaction with the gravitational (free) convection and the small scale alternating of the magnetic fluid particles form a number of vertically stacked magnetic circulation patterns or roll cells, the provision of a wall configuration to take advantage of this circulation pattern or roll cell substantially enhances heat transfer.

What is claimed is:

1. An electromagnetic device producing an external alternating and gradient magnetic field comprising:

a substantially closed liquid retaining container for holding the device having at least one wall in proximity to said device;

a dielectric magnetic fluid retained by the container and submerging said device in said container, said magnetic field producing a circulation pattern in the fluid in the form of a plurality of circular flow paths between said wall and said device;

said wall having an interior configuration substantially matching said circulation pattern to enhance heat transfer from said device to said wall.

2. A device as in claim 1 where said circular flow paths are relatively distinct from one another to form a plurality of magnetic circulation or roll cells having a rotation or circulation around an axis.

3. A device as in claim 2 where adjacent roll cells counter rotate with respect to each other to provide at some point substantially zero velocity difference between roll cells.

4. A device as in claim 1 where heat transfer from said electromagnetic device through said magnetic fluid to said wall occurs mainly through an increase in said fluid's effective thermal conductivity.

5. A device as in claim 1 where the external surface of the wall includes a grid for transferring heat to the surrounding ambient air.

6. A device as in claim 2 where said roll cells are substantially vertically stacked with axes which are substantially horizontal.

7. A device as in claim 1 where said wall is in close enough proximity to said device so that said magnetic fluid in proximity to said wall is still affected by said magnetic field.

8. A device as in claim 1 where said interior configuration of said wall is in the form of arcuate segments substantially matching said circular flow paths.

9. A device as in claim 1 where said interior configuration of said wall is in the form of spaced horizontal protuberances substantially matching the plurality of circular flow paths.

10. A device as in claim 1 where said interior configuration of said wall is in the form of spaced vertical protuberances providing additional surface area for enhancing heat transfer.

11. A device as in claim 10 where said external wall includes vertical protuberances for radiation, conduction, and convection to the air which are juxtaposed with said interior vertical protuberances.

12. A device as in claim 1 where said interior configuration of said wall includes partial hollow rings extending from said wall having a radius of curvature similar to that of said circular flow paths.

13. A method of cooling an electromagnetic device producing an external alternating and gradient magnetic field comprising the following steps:

immersing said device in a dielectric magnetic fluid whereby such alternating and gradient magnetic field causes such fluid to have a circulation pattern in the form of a plurality of circular flow paths; and enclosing said immersed device in a container which has an interior configuration to match said circulation pattern to enhance heat transfer from said device to said wall.

14. A magnetic fluid cooling system comprising:

an active device which generates heat;

a substantially closed liquid container having at least one wall in proximity to said device for holding the device and filled with said magnetic fluid which is a dielectric to immerse said device;

means for producing an alternating and gradient magnetic field which at least passes through said magnetic fluid in proximity to said device for producing a circulation pattern in said fluid in the form of a plurality of circular flow paths between the wall and the device;

said wall having an interior configuration substantially matching said circulation pattern to enhance heat transfer between said device and said wall by increasing the effective thermal conductivity of said magnetic fluid.

15. A system as in claim 14 where said device is a transformer which also produces said alternating magnetic field.

* * * * *

UNITED STATES PATENT AND TRADEMARK OFFICE

CERTIFICATE OF CORRECTION

PATENT NO. : 5,898,353

DATED : April 27, 1999

INVENTOR(S) : TAHIR CADER, et al.

It is certified that error appears in the above-indentified patent and that said Letters Patent is hereby corrected as shown below:

On the front page of the patent, change the title [54] and Col. 1, line 1, from "MAGNETIC FLUID COOLER TRANSFORMER" to --MAGNETIC FLUID COOLED TRANSFORMER--.

Signed and Sealed this

Twenty-ninth Day of August, 2000

*Attest:*

*Attesting Officer*

Q. TODD DICKINSON

*Director of Patents and Trademarks*